United States Patent [19]

Tabata et al.

[11] 4,012,269

[45] Mar. 15, 1977

[54] METHOD OF MAKING A WATER BED

[75] Inventors: John D. Tabata, Los Angeles; Enrique Cantillo, Santa Ana; Frank M. Tabata, Los Angeles, all of Calif.

[73] Assignee: American Thermo-Seal, Inc., Los Angeles, Calif.

[22] Filed: Oct. 17, 1975

[21] Appl. No.: 623,467

Related U.S. Application Data

[62] Division of Ser. No. 470,956, May 17, 1974, Pat. No. 3,918,110.

[52] U.S. Cl. ..... 156/251

[51] Int. Cl.[2] ..... B32B 31/00

[58] Field of Search ..... 156/251; 5/371, 365

[56] References Cited

UNITED STATES PATENTS

| | | | |
|---|---|---|---|
| 2,076,079 | 4/1937 | Gammeter | 156/251 |
| 2,281,976 | 5/1942 | Hansen | 156/251 |
| 3,268,381 | 8/1966 | Ishikawa | 156/251 |
| 3,575,763 | 4/1971 | Ramsey | 156/251 |
| 3,778,852 | 12/1973 | Penn et al. | 5/60 |
| 3,787,907 | 1/1974 | Pennington et al. | 5/60 |

*Primary Examiner*—Douglas J. Drummond
*Attorney, Agent, or Firm*—Robert J. Schaap

[57] ABSTRACT

A water bed for supporting a body thereon and which comprises upper and lower flat plastic sheets. A first rectangularly shaped continuous peripheral wall extends between and is sealed to the upper and lower sheets to form a water chamber therebetween. The first continuous wall is formed by adjoining four endwise connected segments along four rectangularly spaced corner margin. Each corner margin is formed by heat sealing two adjacent wall segments in the form of an arcuate shape with a reinforcing strip disposed over the corner margin and lap sealed to the two adjacent wall segments. The upper and lower walls extend beyond the first continuous peripheral wall and have flaps which extend in a vertically disposed direction to form a second continuous peripheral wall. These flaps are also lap sealed to each other in order to form the second continuous peripheral wall which thereby forms an air chamber surrounding the water chamber.

16 Claims, 11 Drawing Figures

METHOD OF MAKING A WATER BED

RELATED APPLICATION

This application is a division of copending application Ser. No. 470,956 filed May 17, 1974, now U.S. Pat. No. 3,918,110.

BACKGROUND OF THE INVENTION

This invention relates in general to certain new and useful improvements in water beds, and more particularly, and water beds which include an air chamber surrounding a water chamber in a water bed mattress.

In recent years, water beds have become quite popular and have received wide commercial acceptance. These water beds are relatively simple structures which include a pair of spaced apart upper and lower plastic sheets surrounded by a continuous peripheral side wall to form an inner water chamber or so-called "bladder". The bladder is generally capable of accepting several hundred gallons of water which enables a normal human body to be supported thereon in such manner that all parts of the body which reside in contact with the mattress are supported by the same pressure. In this way, any excessive pressure is prevented from being exerted on any specific portion of the body. Moreover, water beds have been found to be less expensive than the conventional spring and mattress type bed and even more-so, these beds are more easily transported in the empty condition.

In the standardized form of construction, the water bed which essentially constitutes a water mattress, is surrounded by a frame which may be constructed of wood or other structural materials. This frame is designed to provide supporting characteristics and thereby decrease the curvature of the mattress when a body is supported thereon. In this way, a more normal level sleeping surface is provided. These frames oftentimes include a water tight liner material between the frame and the mattress, which provides additional protection for the mattress to reduce the hazard of mattress puncture or other form of rupture. The liner in this frame not only serves to prevent rupture of the mattress from the rigid support frame, but also inherently creates a safety feature in case of a leak in the water bed mattress. If the mattress material should develop a leak, the liner within the frame could contain the water ejecting from the bladder and thereby prevent serious property damage created by several hundred gallons of water.

While a rigid support frame is desirable in order to provide support for the side wall of the water bed mattress, and to enable the availability of a liner in case of water leakage, the actual rigid frame is contradictory to several advantages and purposes of the water bed mattress. One of the distinct advantages of the water bed mattress is that the mattress can be emptied of water and collapsed and folded into a small compact unit for storage and/or transport.

In order to eliminate the necessity of the rigid supporting frame, there have been several proposals to provide a water bed mattress with a surrounding air bladder. It has been proposed that the air bladder which surrounds the water bladder will provide for retention of the water bladder side wall against outward deflection under the influence of water pressure. Several forms of construction of water beds or water bed mattresses of this type have been proposed and are exemplified by U.S. Pat. No. 3,778,852 and U.S. Pat. No. 3,787,907.

Each of the water beds proposed in the prior art, as exemplified by the abovesaid patents, also suffer several limitations which militate against their use. One of the very important features of a water bed which includes a water bladder surrounded by an air bladder is that the air bladder must be sufficiently strong to withstand the pressure exerted by the water included within the water bladder when the mattress is filled.

Each of the water bed mattresses thus far proposed are constructed of plastic sheet material components. These components are generally sealed together by means of conventional heat seal techniques. Inasmuch as the various mattress components are formed with with mating engagable flanges or flaps these seals almost inevitably become butt seals, even though a lap seal would provide far more strength and durability if constructed properly.

Notwithstanding the above, these commercially available mattresses which include both the water bladder and the air bladder are rather complex in their construction which materially adds to the cost of manufacturers and sales price thereof. As a result thereof, these latter forms of water bed mattresses which include both the water bladder and the air bladder have not received the wide commercial acceptance which would otherwise be forthcoming if they provided the required support and in addition could be manufactured at a relatively low cost.

It is, therefore, the primary object of the present invention to provide a water bed mattress which includes a water bladder surrounded by an air bladder and which does not require the employment of a rigid frame.

It is another object of the present invention to provide a water bed mattress of the type stated which does not require a rigid support frame, but which nevertheless enjoys all of the advantages provided by the employment of a rigid frame surrounding the water bed mattress.

It is also an object of the present invention to provide a water bed mattress of the type stated which avoids the necessity of a rigid frame, and which also provides for water confinement and bladder deformation which normally arise in a absence of a rigid frame.

It is an additional object of the present invention to provide a water bed mattress of the type stated including sections which are lap sealed to each other in order to create the necessary water bed mattress components and which provide increased rigidity and structural use.

It is a further object of the present invention to provide a water bed mattress of the type stated which can be manufactured at a relatively low unit cost and which nevertheless fulfills all of the characteristics of a water bed mattress which requires the employment of a rigid support frame.

It is another salient object of the present invention to provide a method of making water bed mattress which requires a minimum of manual attention and thereby substantially reduces the cost of manufacture of the water bed mattress without sacrificing the desired structural capability.

With the above and other ojbects in view, our invention resides in the novel features of form, construction, arrangement, and in combination of parts presently described and pointed out in the claims.

GENERAL DESCRIPTION

In general terms, the present invention relates to a water bed for supporting a body thereon. This water bed comprises upper and lower walls. A first continuous peripheral wall extends between the upper and lower walls and forms a water chamber therebetween. A first water tight seal secures the upper wall to the upper margin of the first continuous peripheral wall continuously along the entire peripheral length thereof. A second water tight seal secures the lower wall to the lower margin of the first continuous peripheral wall continuously along the entire peripheral length thereof. The upper and lower walls extend beyond the first continuous peripheral wall. A downwardly extending flap is formed on the upper wall and an upwardly extending flap is formed on the lower wall, and is lap sealed to the downwardly extending flap to form a second continuous peripheral wall, and which is spaced outwardly from the first continuous peripheral wall. In this way, an air chamber is formed between the upper and lower walls and the first and second continuous peripheral walls surrounding said water chamber.

The water bed can be characterized in further detail in that the upper and lower walls are formed of a flexible plastic material. In addition, a first valve means is provided for communication with the water chamber to fill and exhaust water therefrom. A second valve means is provided for communication with said air chamber to fill and exhaust air therefrom.

In a preferred embodiment of the invention, the downwardly struck flap is a continuous peripheral flap surrounding the periphery of the upper wall and is integral therewith. The flap on the lower wall has an upwardly struck continuous peripheral flap surrounding the periphery of the lower wall and is integral therewith. In another embodiment of the invention, the downwardly extending flap on the lower wall is sealed thereto. In yet another embodiment of the invention, the flaps on the upper and lower walls have tabs respectively overlying the upper and lower walls and which tabs are sealed to the upper and lower walls.

The water bed of the present invention can also be described in general terms as comprising upper and lower walls with a first continuous peripheral wall extending between the upper and lower walls and forming a water chamber therebetween. A first water tight seal secures the upper wall to the upper margin of the continuous peripheral wall continuously along the entire peripheral length thereof. A second water tight seal secures the lower wall to the lower margin of the continuous peripheral wall continuously along the entire peripheral length thereof. The upper and lower walls extend beyond the first continuous peripheral wall. A second continuous peripheral wall is located outwardly of said first continuous wall and which is in spaced apart relationship therefrom. In this way, an air chamber is formed between the upper and lower walls and the first and second continuous peripheral walls surrounding said water chamber. The first peripheral wall is provided with an upstanding wall section which is permanently convex to the water chamber. In addition, the upper and lower margins are permanently spaced outwardly from the water chamber with respect to a midpoint of the upstanding wall section located between the upper and lower margins.

The water bed of the present invention can also be characterized in that the first peripheral wall comprises a plurality of wall sections which are connected by arcuately shaped corner margins. A reinforcing strip is disposed over each of the corner margins and is sealed to the wall sections at these corner margins. Preferably, the reinforcing strip is lap sealed to these wall sections at the corner margins. In yet another a preferred aspect of the present invention, the upper and lower walls are formed of a flexible plastic material.

The water bed immediately described above can be further characterized in that the first peripheral wall has a first pair of spaced apart opposed upstanding wall sections and a second pair of spaced apart opposed upstanding wall sections. A first corner margin connects one of the first pairs of upstanding wall sections with one of the second pair of upstanding wall sections. In addition, a second corner margin connects another of the first pair of upstanding wall sections with the other of the second pair of upstanding wall sections. Each of the aforesaid corner margins are arcuately shaped and convex to the water chamber and concave to the air chamber. A reinforcing strip is disposed over each of the aforementioned corner margins and is lap sealed to the wall sections at these corner margins.

In the more preferred aspect of the water bed of the present invention, the second continuous peripheral wall comprises a downwardly extending flap formed on the upper wall and an upwardly extending flap on the lower wall. These upwardly and downwardly extending flaps are then lap sealed to form the second continuous peripheral wall in the manner previously described. Moreover the downwardly struck flap and the upwardly struck flap surround the peripheries of and are integral with the upper and lower walls, respectively. However, it should also be recognized that these flaps could form the second continuous peripheral wall in any of the embodiments as previously described.

The present invention also relates to a method of making a water bed of the type described. Thus, the water bed will have a pair of spaced apart upper and lower sheets with an inner continuous peripheral wall connected thereto to form a water chamber. In addition, the water bed will also have an outer continuous peripheral wall spaced outwardly from the inner peripheral wall and connected to the upper and lower sheets forming an air chamber surrounding the water chamber. This method comprises the sealing of a first peripheral wall section to a second angularly disposed peripheral wall section forming part of the inner continuous peripheral wall. The first and second wall sections are severed at the point of sealing to present an arcuately shaped sealed edge and which sealed edge is convexly presented toward the water chamber. Thereafter, the outer continuous peripheral wall is sealed with respect to the upper and lower walls to form the air chamber.

The method of making the water bed can be characterized in further detail in that the severing operation takes place simultaneously with the sealing operation of sealing the first wall section to the second wall section. Moreover, a reinforcing strip is also disposed over the arcuately shaped sealed edge and is lap sealed to the first and second wall sections adjacent to the sealed edge.

The method of making the water bed of the present invention can also be further characterized in that the method comprises sealing a third peripheral wall section to a fourth peripheral angularly disposed wall section. The third and fourth wall sections are severed at the point of sealing to provide an arcuately shaped sealed edge which is convexly presented inwardly toward the water chamber. The first wall section is also sealed to the third wall section and the second wall section is sealed to the sealing of the outer continuous peripheral wall with respect to the upper and lower sheets.

In this last named characteristic of the invention, the method comprises disposing a reinforcing strip over each of the arcuately shaped sealed edges for substantially the entire dimension thereof. Each of the reinforcing strips are then sealed to the wall sections forming each such sealed edge. The operation of severing the third and fourth wall sections occurs simultaneously with the sealing of the third wall section to the fourth wall section. Furthermore, the operation of severing the first and second wall sections occurs simultaneously with the sealing of the first wall section to the second wall section.

In the preferred aspect of the present invention, the outer continuous peripheral wall comprises a downwardly extending flap on the upper wall and an upwardly extending flap on the lower wall. The sealing of the outer continuous wall with respect to the upper and lower walls comprises lap sealing the upwardly and downwardly extending flaps to each other.

BRIEF DESCRIPTION OF THE DRAWINGS

Figure 1:
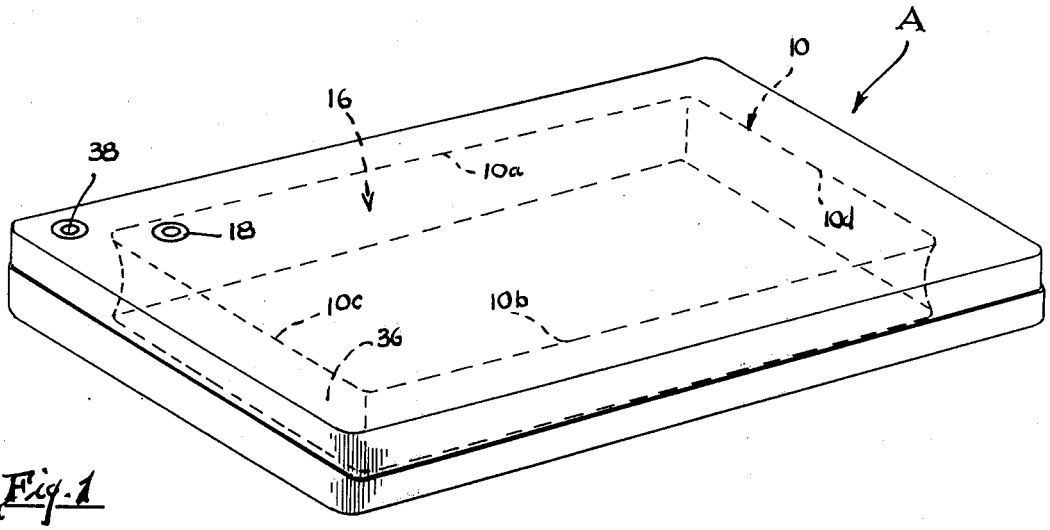
Figure 2:
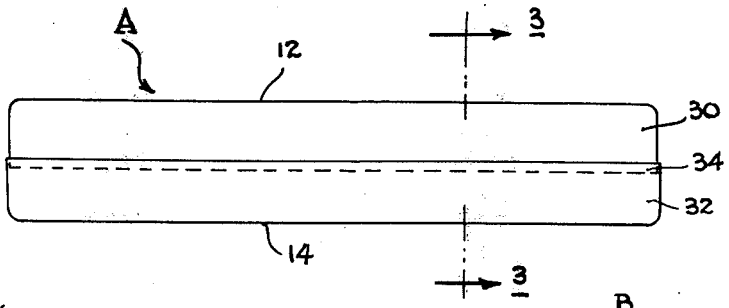
Figure 3:
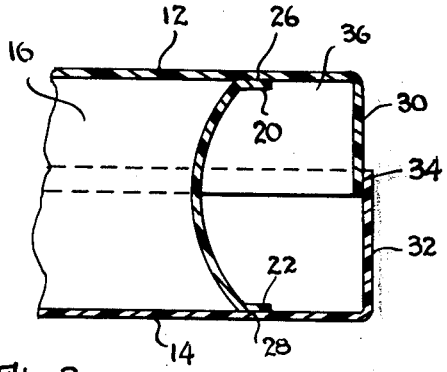
Figure 4:
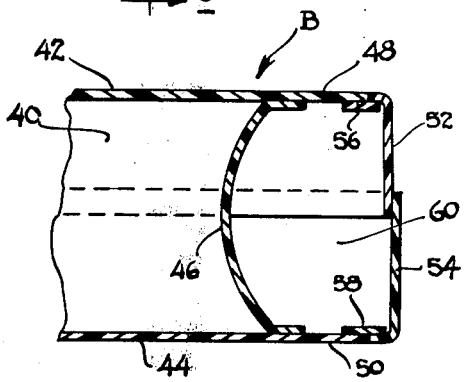
Figure 5:
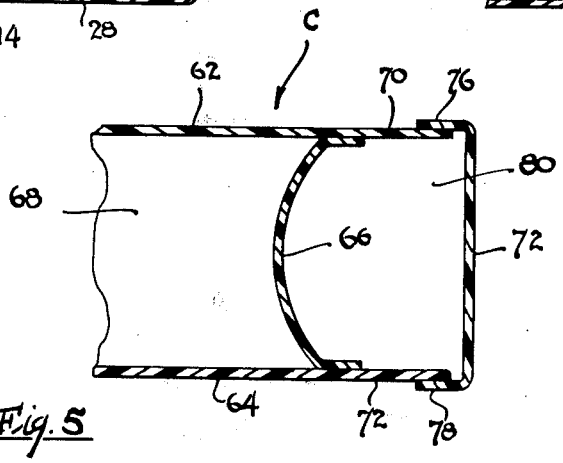
Figure 6:
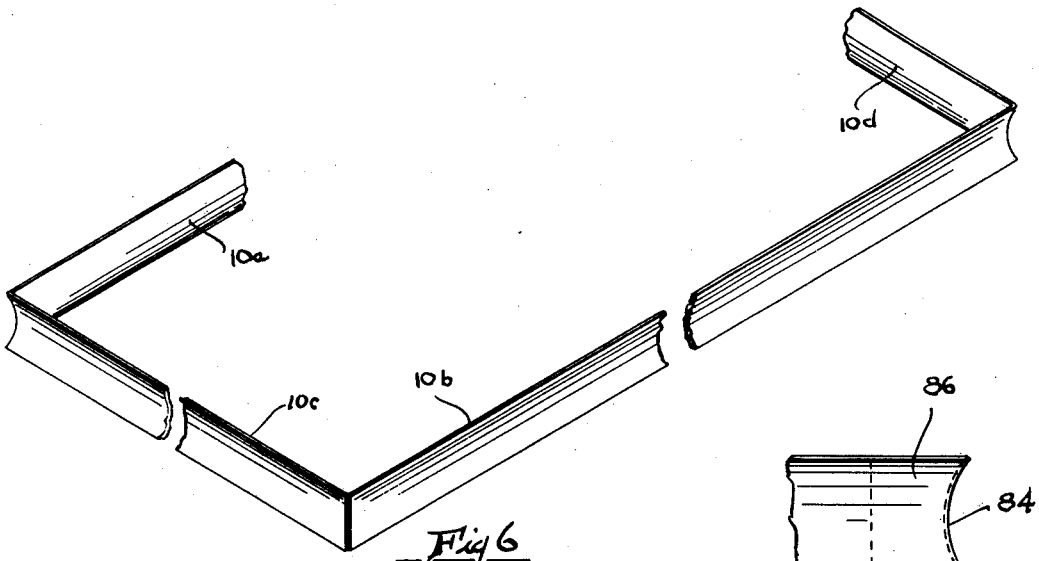
Figure 9:
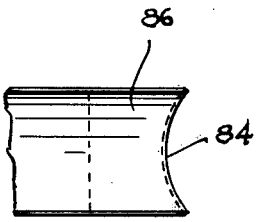
Figure 7:
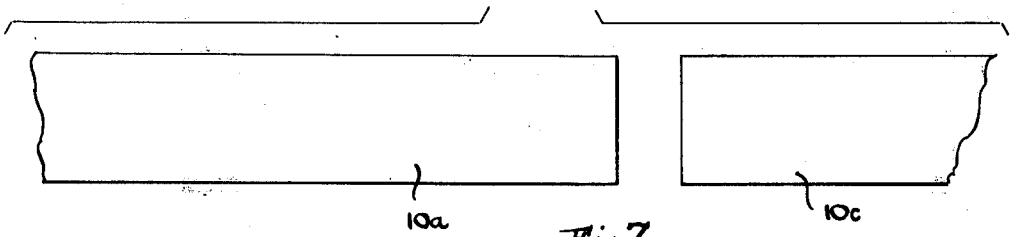
Figure 10:
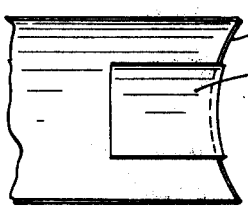
Figure 8:
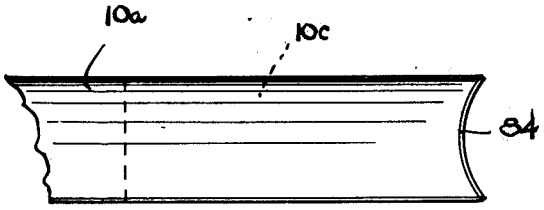
Figure 11:
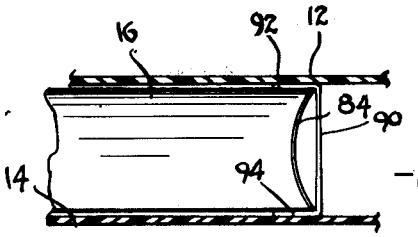

Having thus described the invention in general terms, reference will now be made to the accompanying drawings in which:

FIG. 1 is a perspective view of a water bed mattress constructed in accordance with and embodying the present invention;

FIG. 2 is a side elevational view of the water bed mattress of FIG. 1;

FIG. 3 is a fragmentary vertical sectional view taken along line 3—3 of FIG. 2;

FIG. 4 is a fragmentary vertical sectional view, similar to FIG. 3, and showing a modified form of a water bed mattress constructed in accordance with and embodying the present invention;

FIG. 5 is a fragmentary vertical sectional view, similar to FIG. 3, and showing an additional modified form of water bed mattress constructed in accordance with and embodying the present invention;

FIG. 6 is a perspective view partially broken away, showing the method of constructing a portion of the water bed mattress of the present invention by sealing four rectangularly located peripheral side wall sections thereof;

FIG. 7 is a side elevational view, partially broken away, and showing a longitudinal sidewall section and a lateral sidewall section forming part of an inner peripheral continuous wall;

FIG. 8 is a side elevational view, partially broken away, and showing the corner margin formed by attaching the two side wall sections of FIG. 7;

FIG. 9 is a side elevational view, partially broken away, and showing a banding strap disposed over a corner margin of the two sections in FIG. 8;

FIG. 10 is a side elevational view, partially broken away, and similar to FIG. 9, with a modified form of banding member disposed over the corner margin; and FIG. 11 is a vertical sectional view showing a portion of another modified form of water bed construction in accordance with the present invention.

DETAILED DESCRIPTION

Referring now in more detail and by reference characters to the drawings which illustrate practical embodiments of the present invention, A designates a water bed comprising an inner continuous peripheral side wall 10. This side wall 10 is preferably comprised of a pair of spaced apart longitudinally extending side wall sections 10*a* and 10*b* and a pair of transversely extending side wall sections 10*c* and 10*d*, which are respectively connected to the longiudinally extending side wall sections 10*a* and 10*b*, in the manner as illustrated in FIG. 1.

Upper and lower sheets 12 and 14 respectively extend across the upper and lower margins of the continuous peripheral side wall 10, and thereby define an interior water chamber or so-called water "bladder" 16. The water chamber 16 may be provided with a valve 18 provided for filling and removal of water from the interior bladder 16. This valve is essentially conventional in its construction and one form of the valve construction which may be used is described in the aforementioned U.S. Pat. No. 3,787,907.

Each of the side wall sections 10*a*, 10*b*, 10*c* and 10*d* which form the continuous peripheral side wall 10 are integrally provided with upper and lower outwardly extending flanges 20 and 22, respectively. These flanges are lap-sealed to the upper and lower sheets 12 and 14 at lap-seals 26 and 28 respectively, in the manner as illustrated in FIG. 3 of the drawings.

By further reference to FIGS. 1 and 3, it can be observed that the upper and lower sheets 12 and 14 extend beyond the inner continuous peripheral side wall 10 on all sides thereof. The upper sheet 12 is provided with an integrally formed downwardly extending flap 30. In like manner, the lower sheet 14 is provided with an integrally formed upwardly extending flap 32 which is lap sealed with respect to the flap 30 at the seal 34. In this way, the vertically struck flaps 30 and 32, together with the extended portions of the sheets 12 and 14, form an air chamber 36 or so-called "air bladder" which surrounds the water chamber 16. The air chamber 36 may also be provided with a valve 38 for the filling and removal of air from the bladder 36. Again, this value 38 is conventional in its construction.

It has been found in connection with the present invention that the lap seals referred to herein are far more efficient than the butt seals which have been employed in the prior art. Furthermore, and in the same respect, the lap seals are essentially heat seals where two overlapping sections are heat sealed to each other, substantially in the manner as illustrated in FIG. 3 of the drawings.

It has also been found in connection with the present invention that the lap seal which is used herein provides a much greater degree of strength than any other form of heat seal which may be employed as discussed in the prior art. Furthermore, the lap seal provides a much greater degree of uniformity and continuity between two adjacent lap seal sections than that which was otherwise afforded by other forms of sealing, as for example, the butt seal which is taught in the prior art.

FIG. 4 illustrates a modified form of water bed which may also be constructed in accordance with and embodying the invention. The construction of the water bed B is similar in many aspects to the construction of the water bed A and includes a water chamber 40 formed by upper and lower plastic sheets 42 and 44 and at inner continuous peripheral side wall 46. In this respect, it can be observed that the side wall 46 is secured to the upper and lower sheets 42 and 44 in the same manner as the inner peripheral wall 10 was secured to the upper and lower sheets 12 and 14.

The upper and lower sheets have peripheral extended portions 48 and 50. In this case, the independent vertically disposed continuous peripheral flap 52 is heat sealed to the outer edge continuously along the periphery of the extended portion 48 of the sheet 42. In like manner, a vertically disposed continuous peripheral flap 54 is heat sealed to the edge of the extended portion 50 of the sheet 44 along the entire periphery thereof. It should also be observed that four independent flaps in a rectangular arrangement could be heat sealed to the extended portion 48 of the upper sheet as well as four independent flaps heat sealed to the extended portion 50 of the lower sheet 44. The seal between the extended portions 48 and 50 to the various flaps 52 and 54 may be further reinforced by means of plastic tabs 56 and 58 respectively, in the manner as illustrated in FIG. 4 of the drawings. In this way, an air chamber 60 is formed in surrounding relationship to the water chamber 40.

FIG. 5 illustrates a further modified form of water bed C constructed in accordance with and embodying the present invention. This water bed C also comprises upper and lower sheets 62 and 64, respectively, and which are sealed to an inner continuous peripheral wall 66 thereby forming a water chamber 68. In this case, the sheets 62 and 64 have extended portions 70 and 72. A continuous peripheral end wall 74 is disposed about the entire periphery of the extended portions 70 and 72 and includes horizontally struck flanges 76 and 78 on the upper and lower ends thereof. The flange 76 is heat sealed to the periphery of the extended portion 70 of the sheet 62 and in like manner, the flange 78 is heat sealed to the extended portion 72 of the sheet 64. In this way, the inner peripheral wall 66, the outer vertically disposed wall 72, along with the extended portions 70 and 72 form an air chamber 80 which surrounds the water chamber 68.

FIGS. 6–11 illustrate additional embodiments of water beds which may be constructed in accordance with the present invention and also illustrate one of the preferred forms of making the water bed of the present invention. In order to describe one of the preferred methods of making the water bed of the present invention, reference will be made to the water bed A illustrated in FIGS. 1–3 of the drawings. In this case, the four peripheral side wall sections 10*a* and 10*b*, 10*c* and 10*d* are all heat sealed together in the manner that is schematically illustrated in FIG. 6.

By reference to FIGS. 7 and 8 can be observed that one longitudinal side wall section 10*a* and one laterally extending side wall section 10*c* are heat sealed and simultaneously severed in order to form an arcuately shaped end margin 84. In order to form this arcuately shaped end margin, the side wall section 10*c* is disposed in facewise engagement over the side wall section 10*a*. Thereafter, a suitable cutting and sealing mechanism simultaneously severes the two sheets into the arcuately shaped edge margin 84 and also seals the two wall sections together in the manner as illustrated. Moreover, when the two side wall sections 10*a* and 10*c* are opened up so that they are angularly disposed to each other at a 90 degree angle, the end margin 84 is convexly presented inwardly with respect to the water chamber 16 and concave with respect to the air chamber 36. In like manner, each of the additional wall sections are also sealed together in order to form the rectangularly shaped inner peripheral wall 10, in the manner as illustrated in FIG. 6 of the drawings.

The corner margin between the two wall sections 10*a* and 10*c* are only lightly heat sealed together. The same holds true with respect to the corner margins between the side wall sections 10*c* and 10*b* and in like manner, the corner margins between the remaining wall sections are also only lightly heat sealed to provide arcuate margins convexly presented toward the water chamber 16. The dies used to cut and seal the corner margins are conventional and include an arcuately shaped cutting edge which is also capable of being heated to form the heat seal. Thereafter, a reinforcing strip extending for the entire vertical dimension of the side wall sections is disposed over the corner margin and sealed to the two engaging side wall sections. Thus, for example, with reference to FIG. 9, it can be observed that a reinforcing strip 86 is disposed over the corner margin 84 and is lap sealed to the longitudinal side wall section 10*a* and to the longitudinal side wall section 10*c*. In this way, a very short lap seal is obtained. The amount of overlap between the reinforcing strip 86 and the side wall sections can vary, although it is preferred that the overlap between the reinforcing strip 86 and each of the side wall sections 10*a* and 10*c*, for example, be at least approximately three inches.

FIG. 10 illustrates a modified form of water bed construction which is substantially similar to that previously described, except that a reinforcing strip 88 is employed which does not extend for the full vertical dimension of the two abutting side wall sections. In this case, the seal 84 would be substantially stronger.

FIG. 11 illustrates a further modified form of water bed construction and in this case, the inner peripheral side wall 10 is provided with a restraining band 90. In this case, it can be observed that the corner margin 84 of any two of the side wall sections of the inner peripheral side wall 10 is also arcuately shaped and convexly presented inwardly toward the water chamber 16. However, prior to the application of the upper and lower sheets 12 and 14, respectively, the reinforcing band 90 is disposed over the seal 84. The reinforcing band includes a pair of horizontally struck flanges 92 and 94 which are also heat sealed to the upper and lower sheets 12 and 14, respectively.

In each of the previously described embodiments of the water bed of the present invention, any of a number of plastic materials may be used, and include for example, various forms of vinyl sheets, polyethylene, polystyrene and polybutadiene copolymers and the like. The upper and lower sheets as well as the outer and inner peripheral side walls should preferably have a thickness of no less than 10 mls. However, the desired thickness may be predicated upon the overall size of the mattress itself.

Thus there has been illustrated and described various forms of novel water bed constructions as well as a method of making the same and which water beds can be made at a relatively low cost and used in a wide variety of applications. Consequently, the water beds described herein and the methods of making the same fulfill all the objects and advantages sought therefore. Many changes, modifications, variations and other uses in applications of water beds and the method of making the same will become apparent to those skilled in the art after considering this specification and the accompanying drawings. All such changes, modifications, variations and other uses and applications which do not depart from the spirit and scope of the invention are deemed to be covered by the invention which is limited only by the following claims.

Having thus described our invention, what we desire to claim and secure by letters patent is:

1. A method of making a generally rectangularly shaped water bed mattress for supporting a body thereon and where said mattress comprises upper and lower generally rectangular walls, with a first continuous inner wall of generally rectangular configuration extending between said upper and lower walls and forming a water chamber therebetween, and a second continuous peripheral wall of generally rectangular configuration located outwardly of said first continuous wall and which is in spaced apart relationship therefrom, thereby forming an air chamber between portions of said upper and lower walls and said first continuous inner wall and second continuous peripheral wall and which air chamber surrounds said water chamber; said method comprising forming an an inner continuous peripheral wall from a plurality of upstanding sections which are connected at corner margins by permanently formed arcuate segments which are permanently convex to said water chamber, forming a first water tight lap seal securing said upper wall to the upper margin of said continuous inner wall continuously along the entire peripheral length thereof, forming said first continuous inner wall with said upstanding wall sections having a sufficient amount of material so that all wall sections of said inner wall are permanently convex to said water chamber and with said upper and lower margins thereof being permanently spaced outwardly from said water chamber with respect to a midpoint of said upstanding wall sections located between said upper and lower margins, and where the upper and lower margins of said arcuately shaped corner margins are also spaced outwardly from said water chamber with respect to the midpoints of said arcuate segments forming said corner margins.

2. The method of making a water bed mattress of claim 1 further characterized in that said first peripheral wall comprises four rectangularly located upstanding wall sections and which wall sections are connected through four arcuately shaped corner margins, and said method comprises disposing a reinforcing strip over each of said corner margins and lap sealing said reinforcing strips to the wall sections at said corner margins.

3. The method of making a water bed having a pair of spaced apart upper and lower sheets with an inner continuous wall connected thereto forming a water chamber and an outer continuous peripheral wall spaced outwardly from said inner wall and connected to said upper and lower sheets forming an air chamber surrounding said water chamber; said method comprising sealing a first inner wall section to a second inner wall section forming part of said inner continuous wall, severing excess material from the first and second wall sections at the point of sealing to present an arcuately shaped sealed edge, shifting the first of said wall sections away from the second of said wall sections so the two are angularly disposed to each other and connected by said arcuately shaped sealed edge which constitutes a corner margin and which sealed edge is permanently convexly presented toward said water chamber, sealing the upper and lower edges of said inner wall sections to the respective upper and lower sheets so that the wall sections are angularly disposed at the sealed edge and where the corner margin is permanently convexly shaped toward said water chamber, and sealing the outer continuous peripheral wall with respect to said upper and lower walls to form said air chamber.

4. The method of making the water bed of claim 3 further characterized in that the severing operation severs the excess material from the first and second wall sections to form an arcuately shaped sealed corner edge and the severing operation takes place simultaneously with the sealing operation of sealing the first wall section to the second wall section.

5. The method of making the water bed of claim 3 further characterized in that a reinforcing strip is disposed over the arcuately shaped sealed edge and is lap sealed to the first and second wall sections adjacent to the sealed edge.

6. The method of making the water bed of claim 3 further characterized in that said method comprises sealing a third inner wall section to a fourth inner wall section, severing excess material from said third and fourth wall sections at the point of sealing to provide an arcuately shaped sealed edge which is permanently convexly presented inwardly toward said water chamber, shifting the third and fourth wall sections so that they are angularly disposed to each other and connected by the last-mentioned arcuately shaped sealed edge, sealing the first wall section to the third wall section and the second wall section to the fourth wall section prior to the sealing of the outer continuous peripheral wall with respect to the upper and lower sheets.

7. The method of claim 6 further characterized in that the operation of severing the third and fourth wall sections occurs simultaneously with the sealing of the third wall section to the fourth wall section, and that the operation of severing the first and second wall sections occurs simultaneously with the sealing of the first wall section to the second wall section.

8. The method of claim 7 further characterized in that said method comprises disposing a reinforcing strip over each of said arcuately shaped sealed edges for substantially the entire dimension thereof and lap sealing each of said reinforcing strips to the wall sections forming each such sealed edge.

9. The method of claim 6 further characterized in that the outer continuous peripheral wall comprises a downwardly extending flap on said upper wall and an upwardly extending flap on said lower wall, and that the sealing of the outer continuous wall with respect to the upper and lower walls comprises lap sealing the upwardly and downwardly extending flaps to each other.

10. A method for making a water bed mattress for supporting a body thereon and which water bed mattress comprises upper and lower walls, a first continuous inner wall extending between said upper and lower walls and forming a water chamber therebetween, and a continuous peripheral outer wall connected to said upper and lower walls and forming an air chamber surrounding said water chamber; said method comprising sealing a first inner wall section to a second inner wall section forming part of said continuous inner wall, severing excess material from the first and second wall sections at the point of sealing to present an arcuately shaped sealed edge, shifting the first of said wall sections away from the second of said wall sections so the two are angularly disposed to each other and connected by said arcuately shaped sealed edge which constitutes a corner margin and which sealed edge is permanently convexly presented toward said water chamber, sealing the upper and lower edges of said inner wall sections to the respective upper and lower sheets so that the wall sections are angularly disposed at the sealed edge and where the corner margin is permanently convexly shaped toward said water chamber, forming a downwardly extending flap on said upper wall, forming an upwardly extending flap on said lower wall, and lap sealing said upwardly extending flap to said downwardly extending flap to form a second continuous peripheral wall spaced outwardly from said first continuous inner wall, thereby forming an air chamber between portions of said upper and lower walls and said first continuous inner wall and second continuous peripheral wall surrounding said water chamber.

11. The method for making the water bed mattress of claim 10 further characterized in that said upper and lower walls and said first and second continuous walls are formed of a flexible plastic material.

12. The method of making a water bed mattress of claim 10 further characterized in that said method comprises disposing a reinforcing strip over each of said corner margins and lap sealing reinforcing strips to the wall sections at said corner margins.

13. The method for making the water bed mattress of claim 10 further characterized in that the method comprises sealing first valve means for communication with said water chamber to fill and exhaust water therefrom and sealing second valve means for communication with said air chamber to fill and exhaust air therefrom.

14. The method of making the water bed mattress of claim 10 further characterized in that the severing operation severs the excess material from the first and second wall sections to form an arcuately shaped sealed corner edge and the severing operation takes place simultaneously with the sealing operation of sealing the first wall section to the second wall section.

15. The method of making the water bed of claim 10 further characterized in that said method comprises sealing a third inner wall section to a fourth inner wall section, severing excess material from said third and fourth wall sections at the point of sealing to provide an arcuately shaped sealed edge which is permanently convexly presented inwardly toward said water chamber, shifting the third and fourth wall sections so that they are angularly disposed to each other and connected by the last-mentioned arcuately shaped sealed edge, sealing the first wall section to the third wall section and the second wall section to the fourth wall section prior to the sealing of the outer continuous peripheral wall with respect to the upper and lower sheets.

16. The method of claim 15 further characterized in that the operation of severing the third and fourth wall sections occurs simultaneously with the sealing of the third wall section to the fourth wall section, and that the operation of severing the first and second wall sections occurs simultaneously with the sealing of the first wall section to the second wall section.

* * * * *